US008608424B2

(12) United States Patent
Jain et al.

(10) Patent No.: US 8,608,424 B2
(45) Date of Patent: Dec. 17, 2013

(54) CONTOURED HONEYCOMB SEAL FOR A TURBOMACHINE

(75) Inventors: Sanjeev Kumar Jain, Bangalore (IN); Joshy John, Bangalore (IN); Sachin Kumar Rai, Ranchi (IN); Rajnikumar Nandalal Suthar, Vadodara (IN)

(73) Assignee: General Electric Company, Schenectady, NY (US)

( * ) Notice: Subject to any disclaimer, the term of this patent is extended or adjusted under 35 U.S.C. 154(b) by 1104 days.

(21) Appl. No.: 12/576,345

(22) Filed: Oct. 9, 2009

(65) Prior Publication Data

US 2011/0085893 A1 Apr. 14, 2011

(51) Int. Cl.
*F01D 11/12* (2006.01)

(52) U.S. Cl.
USPC ..... 415/1; 415/173.3; 415/173.4; 415/173.5; 415/174.4

(58) Field of Classification Search
USPC ..... 415/173.1, 173.3, 173.4, 173.5, 174.4
See application file for complete search history.

(56) References Cited

U.S. PATENT DOCUMENTS

| | | | | | |
|---|---|---|---|---|---|
| 3,876,330 | A * | 4/1975 | Pearson et al. | 416/92 |
| 4,295,787 | A * | 10/1981 | Lardellier | 415/197 |
| 4,623,298 | A * | 11/1986 | Hallinger et al. | 415/139 |
| 5,064,343 | A * | 11/1991 | Mills | 415/173.3 |
| 5,192,185 | A * | 3/1993 | Leonard | 415/170.1 |
| 5,238,364 | A * | 8/1993 | Kreitmeier | 415/173.1 |
| 5,290,144 | A * | 3/1994 | Kreitmeier | 415/173.1 |
| 6,068,443 | A * | 5/2000 | Aoki et al. | 415/173.5 |
| 6,120,242 | A * | 9/2000 | Bonnoitt et al. | 415/9 |
| 6,341,938 | B1 * | 1/2002 | Zegarski et al. | 415/173.4 |
| 6,468,026 | B1 * | 10/2002 | Bonnoitt et al. | 415/9 |
| 7,186,078 | B2 * | 3/2007 | Tanaka | 415/170.1 |
| 7,255,531 | B2 * | 8/2007 | Ingistov | 415/173.1 |
| 7,334,984 | B1 * | 2/2008 | Stine et al. | 415/173.1 |
| 7,407,368 | B2 * | 8/2008 | Tanaka | 415/173.1 |
| 2002/0110451 | A1 * | 8/2002 | Albrecht et al. | 415/173.4 |
| 2004/0151582 | A1 * | 8/2004 | Faulkner | 415/173.1 |
| 2005/0002779 | A1 * | 1/2005 | Tanaka | 415/173.1 |
| 2005/0002780 | A1 * | 1/2005 | Tanaka | 415/173.1 |
| 2005/0042081 | A1 * | 2/2005 | Girard et al. | 415/173.4 |
| 2006/0056961 | A1 * | 3/2006 | Czachor et al. | 415/173.4 |
| 2007/0231127 | A1 * | 10/2007 | Durand et al. | 415/173.1 |
| 2009/0014964 | A1 | 1/2009 | Pu et al. | |

* cited by examiner

*Primary Examiner* — Edward Look
*Assistant Examiner* — Aaron R Eastman
(74) *Attorney, Agent, or Firm* — Cantor Colburn LLP

(57) ABSTRACT

A turbomachine includes a housing having an inner surface, a compressor, a turbine and a rotary member including a plurality of blade members configured as part of one of the compressor and the turbine. Each of the plurality of blade members includes a base portion and a tip portion. The turbomachine also includes a honeycomb seal member mounted to the inner surface of the housing adjacent the rotary member. The honeycomb seal member includes a contoured surface having formed therein a deformation zone. The deformation zone includes an inlet zone and an outlet zone. The inlet zone is spaced a first distance from the tip portion of each of the plurality of blade members and the outlet zone is spaced a second distance from the tip portion of each of the plurality of blade members. The second distance being substantially equal to or less than the first distance.

20 Claims, 4 Drawing Sheets

CONTOURED HONEYCOMB SEAL FOR A TURBOMACHINE

BACKGROUND OF THE INVENTION

The subject matter disclosed herein relates to the art of turbomachines and, more particularly, to a contoured honeycombed seal for a turbomachine.

Turbomachines typically include a compressor operationally linked to a turbine. Turbomachines also include a combustor that receives fuel and air which is mixed and ignited to form hot gases. The hot gases are then directed into the turbine toward turbine blades. Thermal energy from the hot gases imparts a rotational force to the turbine blades creating mechanical energy. The turbine blades include end portions that rotate in close proximity to a stator. The closer the tip portions of the turbine blades are to the stator, the lower the energy loss. That is, reducing the amount of hot gases that pass between the tip portions of the turbine blades and the stator ensures that a larger portion of the thermal energy is converted to mechanical energy.

Where clearance between the tip portions and the interior surface of the turbine casing is relatively high, high energy fluid flow escapes without generating any useful power during turbine operation. The escaping fluid flow constitutes tip clearance loss and is a major source of losses in the turbine. For example, in some cases, the tip clearance losses constitute as much as 20-25% of the total losses in a turbine stage.

BRIEF DESCRIPTION OF THE INVENTION

According to one aspect of the invention, a turbomachine includes a housing having an inner surface, a compressor arranged within the housing, a turbine arranged within the housing and operatively coupled to the compressor and a rotary member including a plurality of blade members configured as part of one of the compressor and the turbine. Each of the plurality of blade members includes a base portion and a tip portion. The turbomachine also includes a honeycomb seal member mounted to the inner surface of the housing adjacent the rotary member. The honeycomb seal member includes a contoured surface having a deformation zone formed by the tip portion of each of the plurality of blade members. The deformation zone includes an inlet zone and an outlet zone. The inlet zone receives an air flow from an upstream end of the one of the compressor and the turbine and the outlet zone is configured and disposed to pass the air flow toward a downstream end of the one of the compressor and the turbine. The inlet zone is spaced a first distance from the tip portion of each of the plurality of blade members and the outlet zone is spaced a second distance from the tip portion of each of the plurality of blade members. The second distance being substantially equal to or less than the first distance such that the air flow passing from the deformation zone is substantially streamlined.

According to another aspect of the invention, a method of sealing a gap between a tip portion of a blade member and an inner surface of a turbomachine housing includes mounting a honeycomb seal member having a contoured surface to the inner surface of the turbomachine housing, and rotating a plurality of blade members arranged within the housing with each of the plurality of blade members including a base portion and a tip portion. The method also includes forming a deformation zone in the contoured surface of the honeycomb seal member with the tip portion of the plurality of blade members with the deformation zone including an inlet zone and an outlet zone, and the outlet zone, and passing an air flow along into the inlet zone of the deformation zone with the inlet zone being spaced a first distance from the tip portion of each of the plurality of blade members. The method further includes guiding the airflow from the outlet zone of the deformation zone with the outlet zone being spaced a second distance from the tip portion of each of the plurality of blade members. The second distance is substantially equal to or less than the first distance such that the air flow passing from the deformation zone is substantially streamlined.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
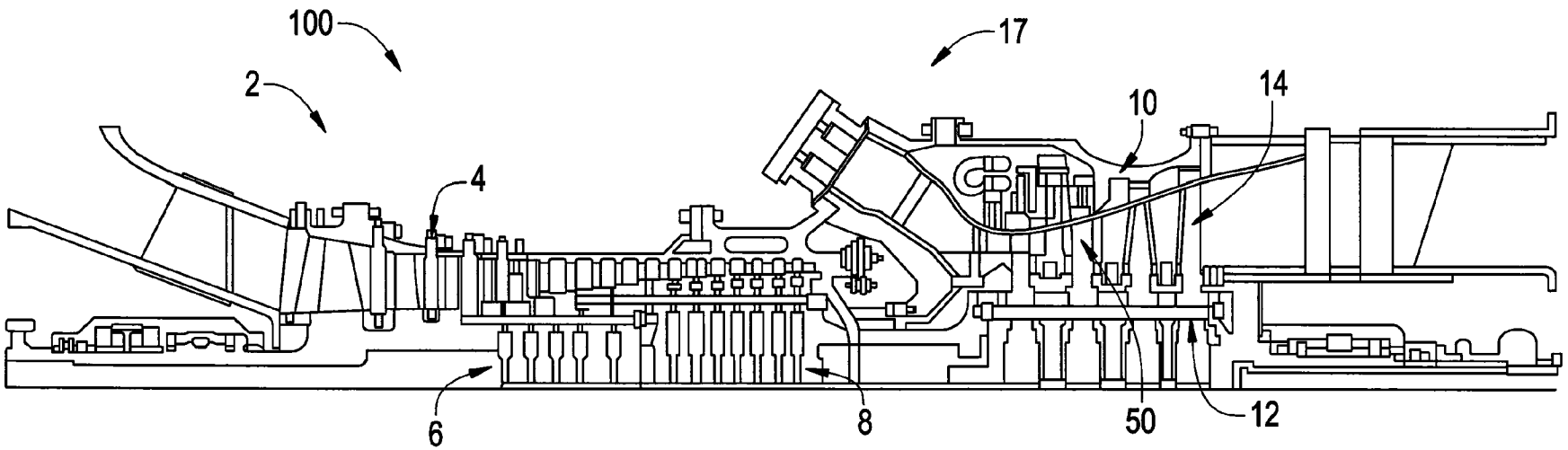
FIG. 1 is a partial schematic view of a turbomachine including a honeycomb seal having a contoured surface in accordance with an exemplary embodiment.
Figure 2:
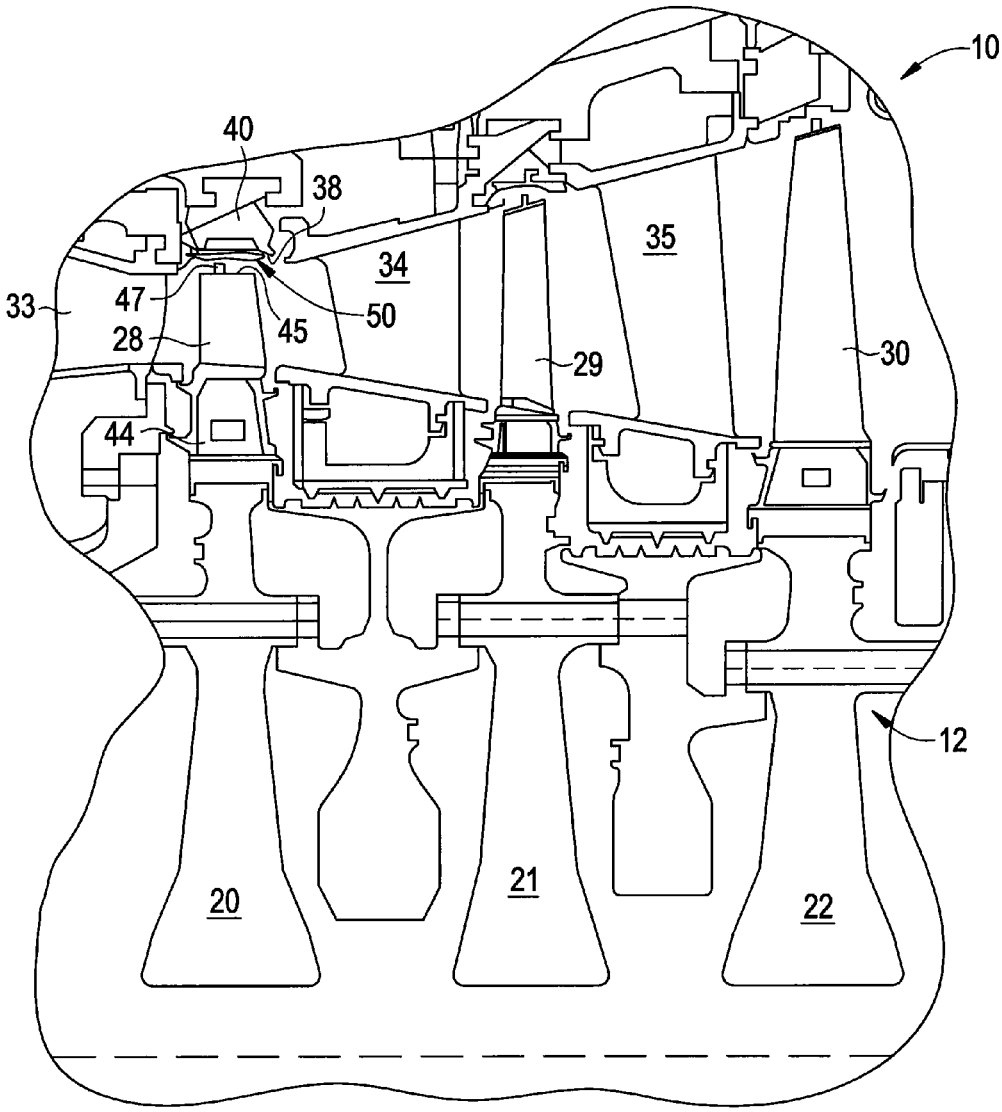
FIG. 2 is a partial schematic view of a turbine portion of the turbomachine of FIG. 1.

With reference to FIGS. 1 and 2, a turbomachine constructed in accordance with an exemplary embodiment is indicated generally at 2. Turbomachine 2 includes a housing 3 within which is arranged a compressor 4. Compressor 4 is linked to a turbine 10 through a common compressor/turbine shaft or rotor 12. Compressor 4 is also linked to turbine 10 through a plurality of circumferentially spaced combustors, one of which is indicated at 17. In the exemplary embodiment shown, turbine 10 includes first, second and third stage rotary members or wheels 20-22 having an associated plurality of blade members or buckets 28-30. Wheels 20-22 and buckets 28-30 in conjunction with corresponding stator vanes 33-35 define various stages of turbine 10. With this arrangement, buckets 28-30 rotate in close proximity to an inner surface 38 of housing 3.

In the exemplary embodiment shown, a plurality of shroud members, one of which is indicated at 40 is mounted to inner surface 38. As will be discussed more fully below, shroud member 40 defines a flow path for high pressure gases flowing over buckets 28-30. At this point, it should be understood that each bucket 28-30 is similarly formed such that a detailed description will follow with respect to bucket 28 with an understanding that the remaining buckets 29 and 30 include corresponding structure. As shown, bucket 28 includes a first or base portion 44 that extends to a second or tip portion 45 having a projection 47. Hot gases flowing from combustor 17 pass across tip portion 45 of buckets 28-30 along inner surface 38. In order to ensure proper flow, a honeycomb seal member 50 is mounted to shroud member 40 adjacent tip portion 45 of bucket 28. Of course, it should be understood that additional honeycomb seal members (not separately labeled) are mounted adjacent to the remaining buckets 29 and 30.

Figure 3:
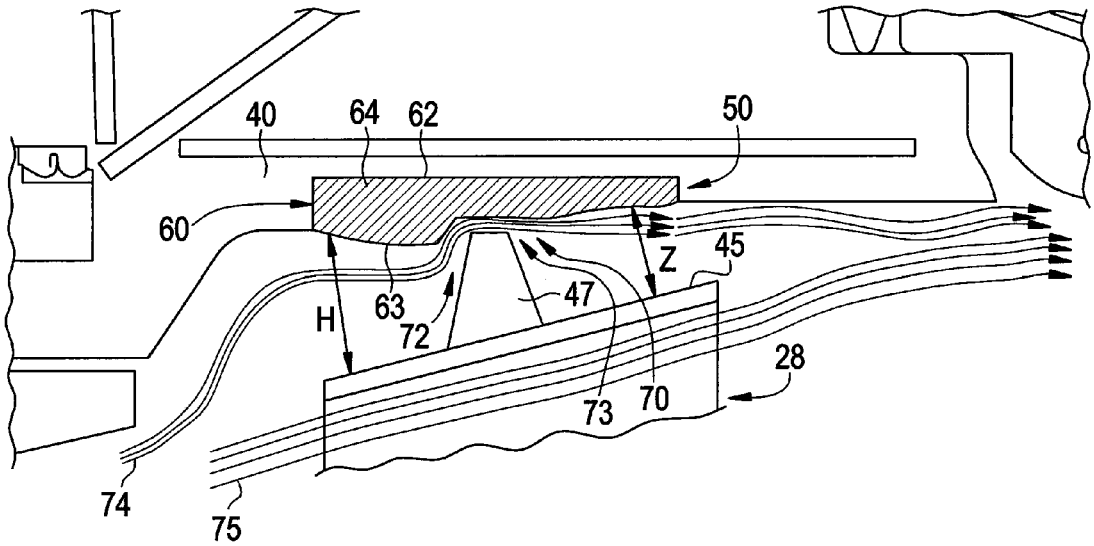
FIG. 3 is a cross-sectional view of the honeycomb seal arranged in the turbine portion of the turbomachine in accordance with an aspect of the exemplary embodiment.
Figure 4:
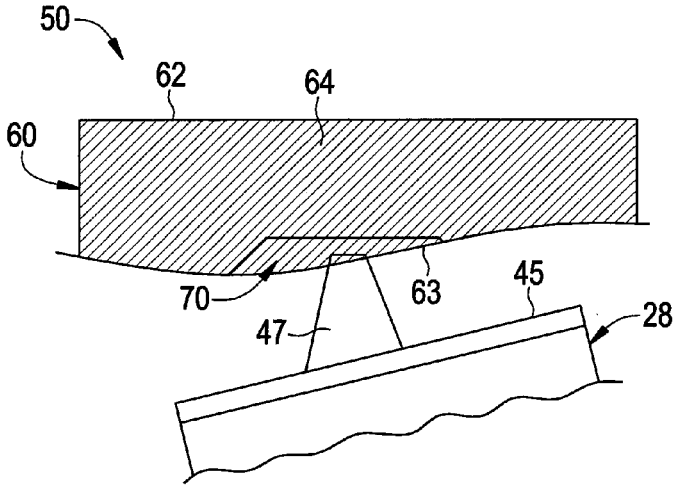
FIG. 4 is a cross-sectional side view of the honeycomb seal prior to formation of a deformation zone in the contoured surface.

As best shown in FIG. 3, honeycomb seal member 50 includes a main body 60 having a first surface 62 that extends to a second, contoured surface 63 through an intermediate portion 64. Honeycomb seal member 50 is formed from an easily deformable material. With this arrangement, operation of turbine 10 causes projection 47 on each of buckets 28 to form a deformation zone or groove 70 across honeycomb seal member 50 such as illustrated in FIG. 4. In the exemplary embodiment shown, deformation zone 70 includes an inlet zone 72 and an outlet zone 73. Inlet zone 72 receives a tip leakage airflow 74 from an upstream end of turbine 10 while the outlet zone is configured to pass the airflow towards a downstream end of turbine 10, e.g., towards the second and third stages. Inlet zone 72 is spaced a first distance H from tip portion 45 of bucket 28, while outlet zone 73 is spaced a second distance Z from tip portion 45 of bucket 28. In accordance with the exemplary embodiment, second distance Z is substantially equal to or less than first distance H such that the tip leakage airflow 74 passing across tip portion 45 exiting outlet zone 73 is substantially streamlined. That is, by providing contoured surface 63 on main body 60, the airflow does not interact with surfaces on honeycomb seal in a way that would create turbulences at tip portion 45. By streamlining tip leakage airflow 74, interactions between a main airflow 75 and tip leakage airflow 74 is reduced and operation of turbomachine 2 is enhanced.

Figure 5:
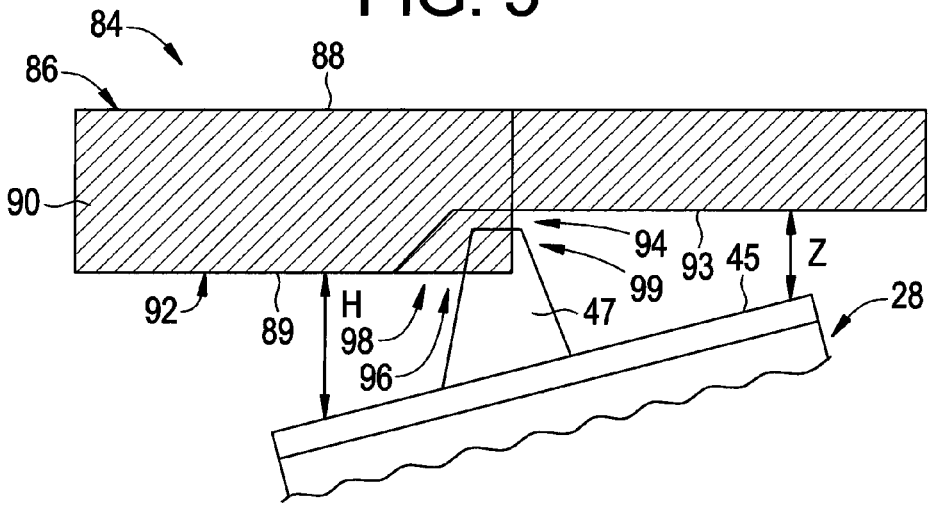
FIG. 5 is a cross-sectional side view of a honeycomb seal in accordance with another aspect of the exemplary embodiment prior to formation of a deformation zone in the contoured surface.

FIG. 5 illustrates a honeycomb seal member 84 constructed in accordance with another aspect of the exemplary embodiment. Seal member 84 includes a main body 86 having a first surface 88 that extends to a second, contoured surface 89 through an intermediate portion 90. Second, contoured surface 89 is substantially linear and includes a first portion 92 that extends to a second portion 93 through a step portion 94. Substantially linear should be understood to mean that contoured surface 89 includes portions that are not curvilinear. The portions that are not curvilinear can however extend at angles relative to one another. As shown, step portion 94 extends substantially perpendicularly to first and second portions 92 and 93. Substantially perpendicularly should be understood to mean that first and second portions are generally arranged 90 degrees relative to one another plus or minus about 10 degrees. With this arrangement, operation of turbine 10 forms a deformation zone 96 at step portion 94. That is, as buckets 28 rotate, projections 47 impact step portion 94 forming deformation zone 96. In a manner similar to that described above, deformation zone 96 includes an inlet zone 98 that extends to an outlet zone 99. Inlet zone 98 is spaced a first distance H from tip portion 45 while outlet zone 99 is spaced a second distance Z from tip portion 45. As shown, second distance Z is less than or substantially equal to first distance H such that airflow existing from outlet zone 99 remains substantially streamlined in a manner similar to that described above.

Figure 6:
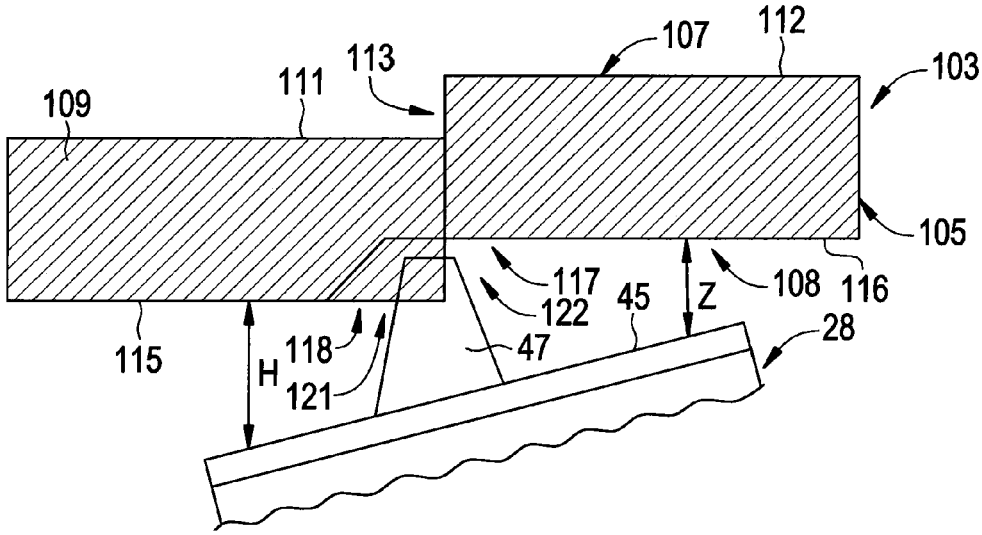
FIG. 6 is a cross-sectional side view of a honeycomb seal in accordance with yet another aspect of the exemplary embodiment prior to formation of a deformation zone in the contoured surface.

FIG. 6 illustrates a seal member 103 constructed in accordance with yet another aspect of the exemplary embodiment. Seal member 103 includes a main body 105 having a first surface 107 that extends to a second, contoured surface 108 through an intermediate portion 109. First surface 107 includes a first section 111 that extends to a second section 112 through a step section 113. Step section 113 is substantially perpendicularly arranged relative to first and second sections 111 and 112 so as to enhance an interface with inner surface 38 of turbine 10. In a manner similar to that described above, second, contoured surface 108 includes a first portion 115 that extends to a second portion 116 through a step portion 117. Step portion 117 is arranged substantially perpendicularly relative to first and second portions 115 and 116. With this arrangement, operation of turbine 10 causes projection 47 of buckets 28 to impact and form a deformation zone 118 at step portion 117. Deformation zone 118 includes an inlet zone 121 and an outlet zone 122. Inlet zone 121 is spaced a first distance H from tip portion 45 while outlet zone 122 is spaced a second distance Z from the tip portion 45. Second distance Z is substantially equal to or less than first distance H such that airflow crossing tip portion 45 and existing outlet zone 122 remains substantially streamlined.

Figure 7:
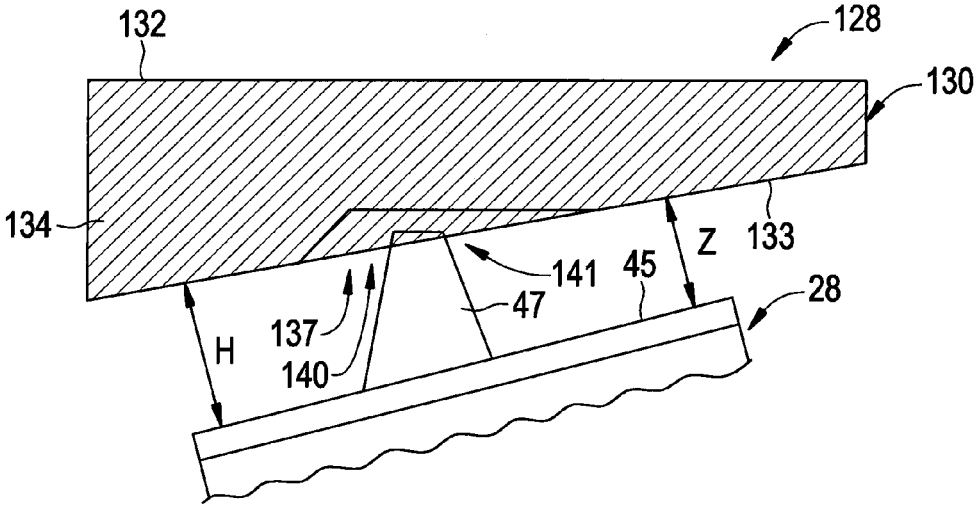
FIG. 7 is a cross-sectional side view of a honeycomb seal in accordance with still another aspect of the exemplary embodiment prior to formation of a deformation zone in the contoured surface.

FIG. 7 illustrates a seal member 128 constructed in accordance with still another aspect of the exemplary embodiment. Seal member 128 includes a main body 130 having a first surface 132 that extends to a second, contoured surface 133 through an intermediate portion 134. Second, contoured surface 133 is arranged at an angle so as to extend along a plain that is substantially parallel to a plain defined by tip portion 45. In a manner similar to that described above, operation of turbomachine 2 causes projection 47 to impact and deform honeycomb seal member 128 so as to form a deformation zone 137 having an inlet zone 140 and an outlet zone 141. Inlet zone 140 is spaced a first distance H from tip portion 45 while outlet zone 141 is spaced a second distance Z from tip portion 45. As shown, second distance Z is substantially equal to or less than first distance H such that an airflow entering deformation zone 137 through inlet zone 140 exits outlet zone 141 and remains substantially streamlined. That is, the particular contour or angle provided on second surface 133 ensures that there is no obstruction that would create turbulence at outlet zone 141.

At this point, it should be understood that the honeycomb seal member constructed in accordance with the exemplary embodiment provides an easily deformed seal between tip portions of rotating bucket members and an inner surface of the turbomachine. The contoured surface provided on the honeycomb seal member ensures that an airflow passing across projections formed on the tip portions of the blade members remains substantially streamlined. That is, the contour includes no obstructions that would interfere with the airflow so as to create turbulences. By ensuring that the airflow remains streamlined, operation of turbomachine 2 is enhanced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a housing having an inner surface;

a compressor arranged within the housing;

a turbine arranged within the housing and operatively coupled to the compressor;

a rotary member including a plurality of blade members configured as part of one of the compressor and the turbine, each of the plurality of blade members including a base portion and a tip portion, the tip portion including at least one projection;

a honeycomb seal member mounted to the inner surface of the housing adjacent the rotary member, the honeycomb seal member having a contoured surface including a deformation zone formed by contact between only a portion of the projection of each of the plurality of blade members and the honeycombed seal member, the deformation zone including an inlet zone and an outlet zone, the inlet zone receiving an air flow from an upstream end of the one of the compressor and the turbine and the outlet zone being configured and disposed to pass the air flow toward a downstream end of the one of the compressor and the turbine, the inlet zone being spaced a first distance from the tip portion of each of the plurality of blade members and the outlet zone being spaced a second distance from the tip portion of each of the plurality of blade members, the second distance being less than the first distance such that the air flow passing from the deformation zone is substantially streamlined.

2. The turbomachine according to claim 1, wherein the contoured surface of the honeycomb seal member is a curvilinear surface.

3. The turbomachine according to claim 1, wherein the contoured surface is a substantially linear surface.

4. The turbomachine according to claim 3, wherein the substantially linear surface extends substantially parallel to the tip portion of each of the plurality of blade members.

5. The turbomachine according to claim 3, wherein the substantially linear surface includes a first portion, a second portion and a step portion, the step portion being arranged between the first and second portions.

6. The turbomachine according to claim 5, wherein the step portion extends substantially perpendicularly to the first and second portions.

7. The turbomachine according to claim 1, further comprising: a shroud member mounted to inner surface of the housing adjacent the rotary member, the honeycomb seal member being mounted to the shroud member.

8. The turbomachine according to claim 1, wherein the rotary member is configured as part of the compressor.

9. The turbomachine according to claim 1, wherein the rotary member is configured as part of the turbine.

10. The turbomachine according to claim 1, wherein the at least one projection comprises a single projection extending from the tip portion.

11. A method of sealing a gap between a tip portion of a blade member and an inner surface of a turbomachine housing, the method comprising:

mounting a honeycomb seal member having a contoured surface to the inner surface of the turbomachine housing;

rotating a plurality of blade members arranged within the housing, each of the plurality of blade members including a base portion and a tip portion having at least one projection;

forming a deformation zone in the contoured surface of the honeycomb seal member with only a portion of the at least one projection of each of the plurality of blade members, the deformation zone including an inlet zone and an outlet zone;

passing an air flow along into the inlet zone of the deformation zone, the inlet zone being spaced a first distance from the tip portion of each of the plurality of blade members; and guiding the airflow from the outlet zone of the deformation zone, the outlet zone being spaced a second distance from the tip portion of each of the plurality of blade members, the second distance being less than the first distance such that the air flow passing from the deformation zone is substantially streamlined.

12. The method of claim 11, wherein forming a deformation zone in the contoured surface includes forming the deformation zone in a curvilinear surface.

13. The method of claim 11, wherein forming a deformation zone in the contoured surface includes forming the deformation zone in a substantially linear surface.

14. The method of claim 13, wherein forming the deformation zone in the substantially linear surface includes forming the deformation zone in a substantially linear surface that extends substantially parallel to the tip portion of each of the plurality of blade members.

15. The method of claim 13, wherein forming the deformation zone in the substantially linear surface includes forming the deformation zone in a substantially linear surface having a first portion, a second portion and a step portion, the step portion being arranged between the first and second portions.

16. The method of claim 15, wherein the deformation zone is formed at the step portion.

17. The method of claim 11, wherein mounting the honeycomb seal to the inner surface of the turbomachine includes mounting the honeycomb seal to a shroud member mounted to inner surface of the housing adjacent the rotary member.

18. The method of claim 11, wherein rotating the plurality of blade members arranged within the housing includes rotating blade members associated with a compressor portion of the turbomachine.

19. The method of claim 11, wherein rotating the plurality of blade members arranged within the housing includes rotating blade members associated with a turbine portion of the turbomachine.

20. The method of claim 11, wherein forming the deformation zone in the contoured surface of the honeycomb seal member with only a portion of the at least one projection includes forming the deformation zone with only a portion of a single projection.

* * * * *